US005263628A

United States Patent [19]

Huang

[11] Patent Number: 5,263,628

[45] Date of Patent: Nov. 23, 1993

[54] PUNCHING ELEMENT OF A STAPLER

[76] Inventor: Bao-Ruh Huang, No. 136, Tzu Chiang Rd., Changhua City, Taiwan

[21] Appl. No.: 994,620

[22] Filed: Dec. 21, 1992

[51] Int. Cl.[5] ..... B25C 5/11

[52] U.S. Cl. ..... 227/134

[58] Field of Search ..... 227/134, 132, 133, 129, 227/120, 146

[56] References Cited

U.S. PATENT DOCUMENTS

| | | | |
|---|---|---|---|
| 2,420,830 | 5/1947 | Maynard | 227/134 |
| 2,664,565 | 1/1954 | Percoco | 227/120 |
| 2,667,639 | 2/1954 | Schick | 227/133 |
| 3,113,317 | 12/1963 | Carlson, Sr. et al. | 227/132 |
| 3,758,016 | 9/1973 | Olney et al. | 227/132 |
| 4,546,909 | 10/1985 | Ebihara | 227/120 |
| 4,878,608 | 11/1989 | Mitsahashi | 227/120 |

*Primary Examiner*—Scott Smith

*Attorney, Agent, or Firm*—Testa, Hurwitz & Thibeault

[57] ABSTRACT

A stapler includes a pair of walls disposed in parallel in a top so that a space is formed between the walls, one or more ribs are formed in the space, and a punching element force-fitted in the space and force-fitted between the ribs such that the punching element is stably retained in place.

3 Claims, 3 Drawing Sheets

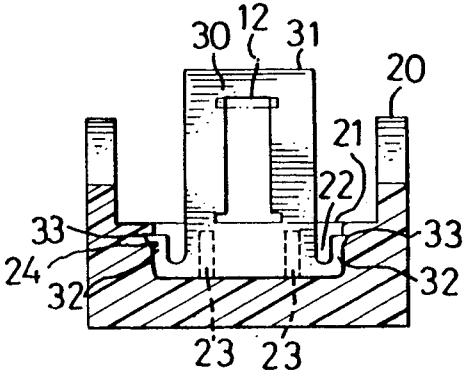
FIG. 2
FIG. 3
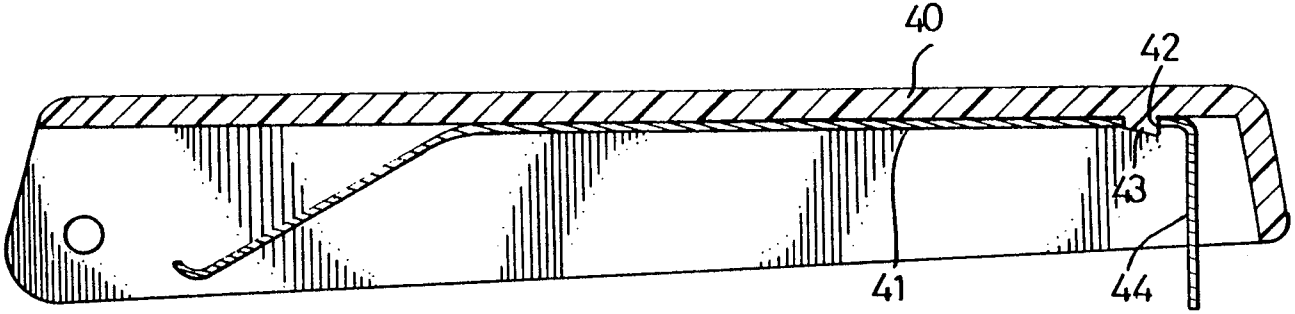
FIG. 4
PRIOR ART

PUNCHING ELEMENT OF A STAPLER

BACKGROUND OF THE INVENTION

1. Field of the Invention

The present invention relates to a stapler, and more particularly to a punching element of a stapler.

2. Description of the Prior Art

A typical punching element 41 of a stapler is shown in FIG. 4 and includes a hole 42 formed therein for engagement with a projection 43 of the top 40 of the stapler, the punching element 41 includes an extension 44 depended therefrom for punching the staples. The punching element 41 and the extension 44 are formed integral with each other and the extension 44 is bent from the punching element 41 such that, generally, the strength of the punching element 41 is not good enough, and such that the working life of the extension 44 is not good.

Another type of punching element is shown in FIG. 5, a cap 55 is pivotally coupled in a top 50 of the stapler and includes a flange 56 formed in the free end portion thereof, a pair of L-shaped protrusions 51 formed in the free end portion of the top 50, and a spring 57 disposed in the top 50; the punching element 52 includes an opening 53 for engagement with the flange 56 and includes a pair of projections 54 extended laterally outwards for engagement with the protrusions 51 such that the punching element 52 is retained in place. However, obviously, the punching element 52 can not be stably retained in place such that the punching element 52 is apt to become loose and will be easily damaged when not aligned with the staples.

The present invention has arisen to mitigate and/or obviate the afore-described disadvantages of the conventional punching elements of the staplers.

SUMMARY OF THE INVENTION

The primary objective of the present invention is to provide a stapler which includes a punching element that is stably and solidly secured in the stapler.

In accordance with one aspect of the invention, there is provided a stapler comprising a top including a free end portion, a pair of wall members disposed in parallel in the free end portion of the top so that a space is formed between the wall members, a first of the wall members including at least one rib formed therein, and a punching element force-fitted in the space and force-fitted between the rib and a second of the wall members such that the punching element is stably retained in place.

The punching element includes a first edge engaged in the space and having two end portions each including a leg formed thereon, each of the legs includes a tip engaged in the top, whereby, the punching element is further stably retained in place.

The top includes a pair of depressions formed in the space for engaging with the tips of the legs respectively. Each of the wall members includes at least one strut secured thereto and located outside of the space for reinforcement purposes.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 2 is a partial plane view showing part of the top of the stapler;

FIG. 3 is a partial cross sectional view of the punching element;

FIG. 4 is a partial cross sectional view illustrating a typical punching element.

DETAILED DESCRIPTION OF THE PREFERRED EMBODIMENT

Figure 1:
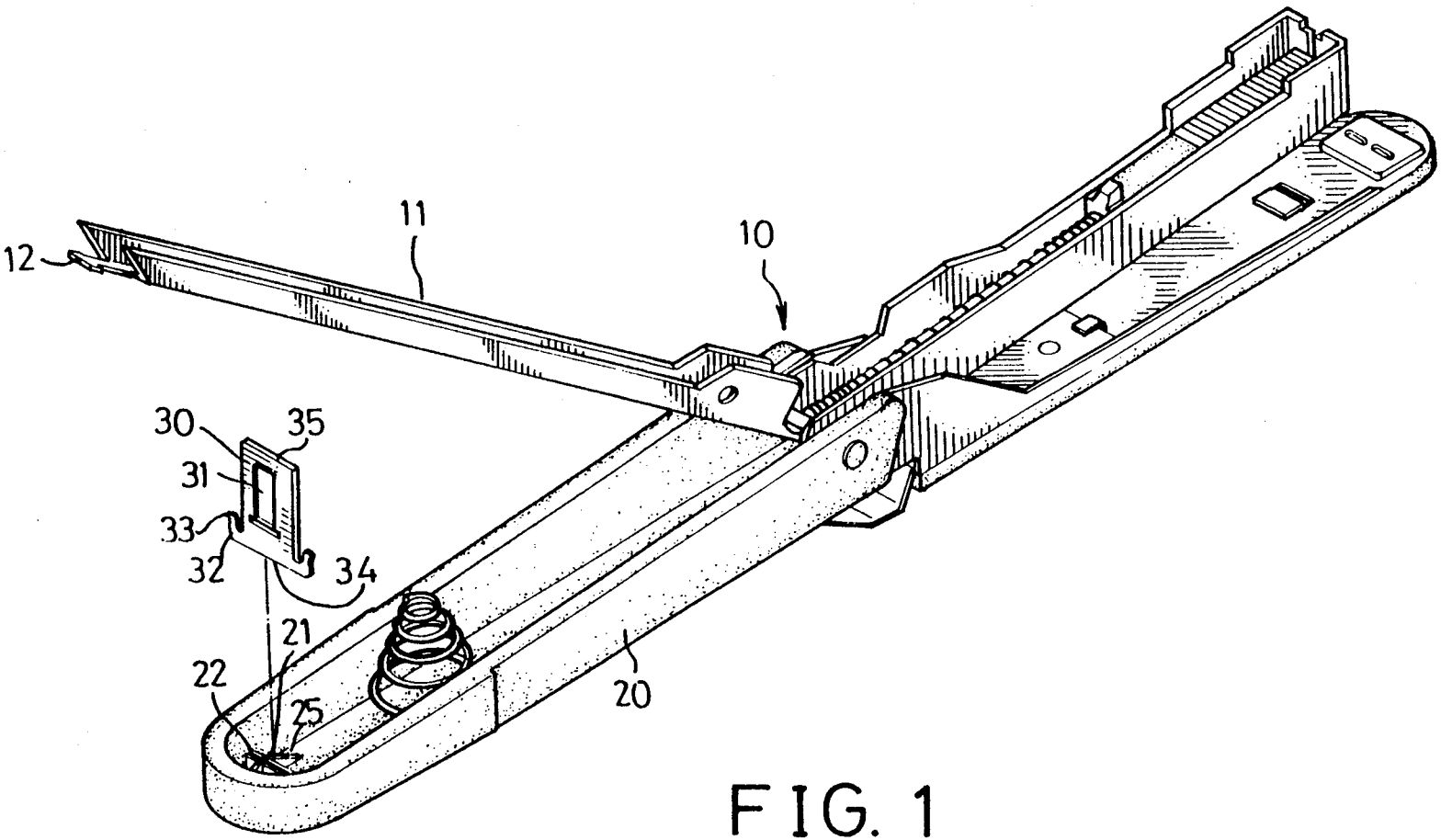
FIG. 1 is a partial exploded view of a stapler having a punching element in accordance with the present invention.
Figure 5:
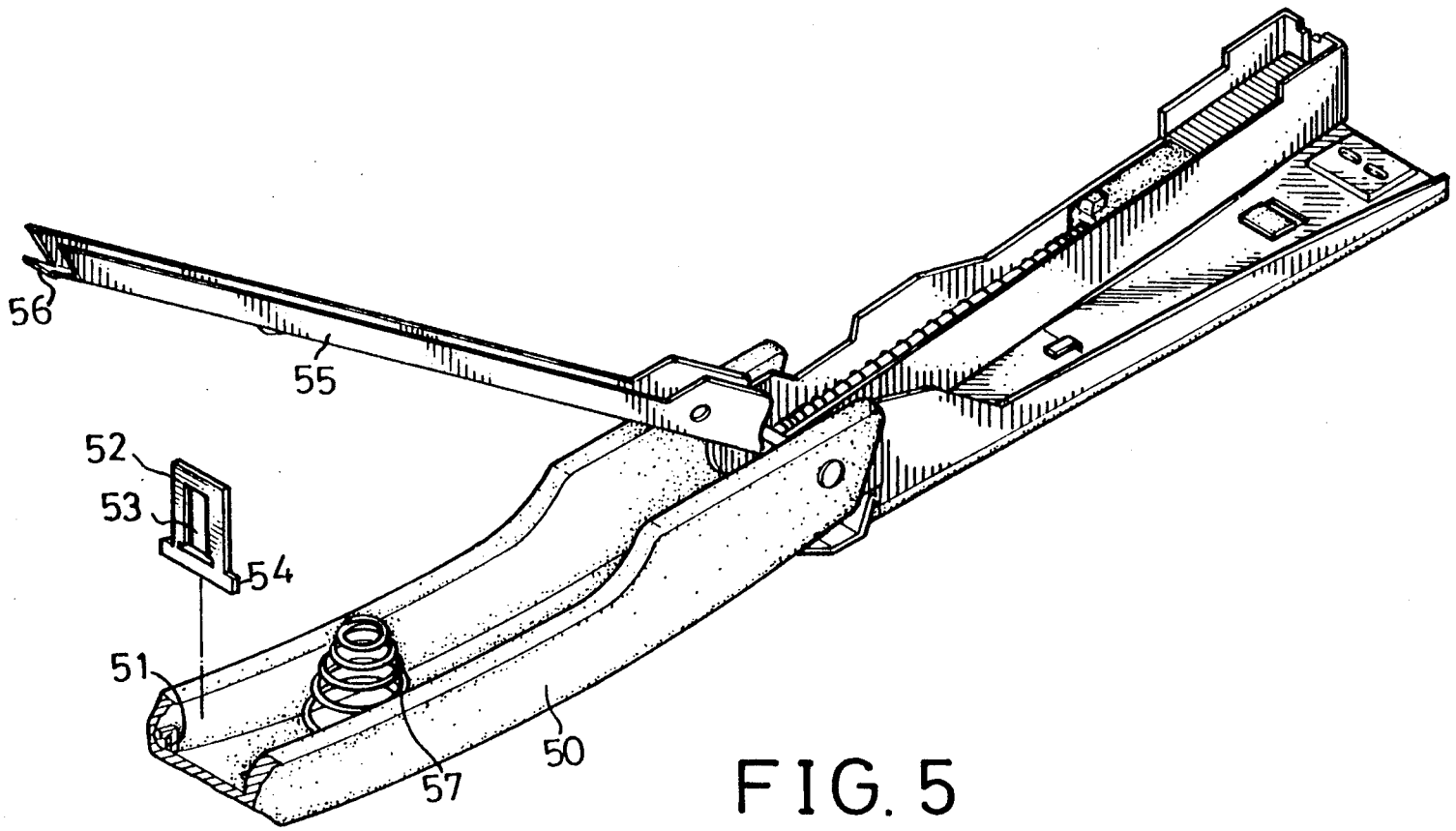
FIG. 5 PRIOR ART
FIG. 5 is a partial exploded view showing another type of punching element.

Referring to FIGS. 1 to 3, a punching element 30 in accordance with the present invention is secured in the free end portion of the top 20 of the stapler 10 for punching the staples. The stapler includes a cap 11 pivotally coupled to the top 20 and includes a flange 12 formed integral on the free end portion thereof. The top 20 includes a pair of wall members 21 disposed in parallel in the free end portion thereof such that a space 22 is formed between the wall members 21, each of the wall members 21 includes at least one strut 25 formed thereon and located on the outer portion of the space 22 for reinforcement purposes. A pair of ribs 23 are formed integral on one of the wall members 21 and located within the space 22.

The punching member 30 in accordance with the present invention includes an opening 31 formed therein for engagement with the flange 12 of the cap 11 and includes a first edge 34 received in the space 22 and a second edge 35 for punching the staples, the punching element 30 can be stably engaged between the ribs 23 and one of the wall members 21, the first edge 34 includes two end portions each having a leg 32 formed integral therewith and extended away from the first edge 34, each of the legs 32 includes a free end portion having a tip 33 extended outward therefrom. As best shown in FIG. 3, the space 22 includes a pair of depressions oppositely formed therein for engagement with the tips 33 of the legs 32 such that the punching element 30 can further be stably retained in place and is prevented from disengaging from the space 22.

It is to be noted that the top 20 is normally made of plastic materials, such that the depressions for receiving the tips 33 of the legs 32 can be formed automatically when the legs 32 of the punching element 30 is forced into the space 22.

Accordingly, the punching element in accordance with the present invention can be stably retained in the top of the stapler and will not become loose.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler comprising a top including a free end portion, a pair of wall members disposed in parallel in said free end portion of said top so that a space is formed between said wall members, a pair of depressions formed in said space, and a punching element including a first edge engaged in said space, said first edge having two end portions which each defines a leg, each of said legs including a tip engaged in one of said depressions.

2. A stapler according to claim 1, wherein a first of said wall members includes at least one rib formed therein, said punching element is force-fitted between said rib and a second of said wall members.

3. A stapler according to claim 1, wherein each of said wall members includes at least one strut secured thereto and located outside of said space for reinforcement purposes.

* * * * *